US005503055A

United States Patent [19]

Hamanaga

[11] Patent Number: 5,503,055

[45] Date of Patent: Apr. 2, 1996

[54] WIND INSTRUMENT FABRICATED FROM METALLIC TUBULAR PARTS WITH INWARDLY ROUNDED ENDS

[75] Inventor: Shinji Hamanaga, Shizuoka, Japan

[73] Assignee: Yamaha Corporation, Japan

[21] Appl. No.: 458,226

[22] Filed: Jun. 2, 1995

Related U.S. Application Data

[63] Continuation of Ser. No. 164,406, Dec. 9, 1993, abandoned.

[30] Foreign Application Priority Data

Dec. 17, 1992 [JP] Japan ..... 4-355129

[51] Int. Cl.[6] ..... G10D 7/10; G10D 9/02

[52] U.S. Cl. ..... 84/387 R; 84/395; 84/399; 84/380 R

[58] Field of Search ..... 84/387 R, 388, 84/389, 390, 391, 392, 393, 394, 395, 396, 397, 398, 399, 401, 330, 380 R, 381, 382, 384, 385 R, 380 A, 380 B, 380 C

[56] References Cited

U.S. PATENT DOCUMENTS 869,619 10/1907 Buescher ..... 84/330
903,059 11/1908 Conn ..... 84/330

*Primary Examiner*—Cassandra C. Spyrou
*Attorney, Agent, or Firm*—Ostrolenk, Faber, Gerb & Soffen

[57] ABSTRACT

A plurality of tubular members are incorporated in a wind instrument for forming an air passage, and each of the tubular members has a tubular portion and a guide portion larger in diameter than the tubular portion and rounding therefrom for forming a hollow space open to the inner space of the tubular portion, thereby preventing the external appearance of the wind instrument from residual electrolyte confined during a plating bath.

12 Claims, 6 Drawing Sheets

WIND INSTRUMENT FABRICATED FROM METALLIC TUBULAR PARTS WITH INWARDLY ROUNDED ENDS

This is a Continuation of application Ser. No. 08/164,406 filed on Dec. 9, 1993 now abandoned.

FIELD OF THE INVENTION

This invention relates to a wind instrument and, more particularly, to rounded metallic tube members of the wind instrument for smooth coupling.

DESCRIPTION OF THE RELATED ART

A wind instrument such as, for example, a trumpet, a French horn, a trombone or a tuba is fabricated from a lot of metallic tubular parts, and the metallic tubular parts are shaped into various configurations. For example, one of the metallic tubular parts is funnel-shaped, and serves as a mouthpiece for buzzing. Another metallic tubular part is straight, and couples the mouthpiece with a bell. A U-shaped metallic tubular part slides into and out of another metallic tubular part for changing the length of a vibratory air column, and a coil-shaped metallic tubular part makes a wind instrument compact.

Thus, various metallic tubular parts are necessary for the wind instruments. Manufacturers design the ends of the metallic tubular parts for easy coupling.

FIGS. 1 and 2 illustrate a typical example of the metallic tubular member forming a part of a prior art wind instrument. The metallic tubular member 1 has a outwardly rounded end portion 1*a*. The metallic tubular member 1 initially has a straight edge, and the straight edge is outwardly rounded so as to form a smaller circle rather than the metallic tubular member 1 per se. The rounded end 1*a* not only reinforces the metallic tubular member 1, but also allows a player to smoothly insert another metallic tubular member 2 into the metallic tubular member 1. This is because there is a gap G between the funnel shaped end portion 1*a* and the straight end of the other metallic tubular member 2.

The prior art outwardly rounded metallic tubular member 1 is coated through a plating bath, and the electrolyte tends to remain in a space 1*b* enclosed in the rounded end portion 1*a*. The electrolyte thus left in the space 1*b* tends to flow out, and thereby tarnishes the plated tubular member 1. In the worst case, the coating film peels from the metallic tubular member 1, and deteriorates the external appearance of the coated tubular member 1.

In order to prevent the coated tubular member 1 from the residual electrolyte, each end of the rounded end portion 1*a* is soldered before the coating, and the electrolyte is confined by the solder pieces 1*c* in the space 1*a*, if any, as shown in FIG. 3.

However, the soldering is manually carried out, and is hardly automated because of the wide variety of configurations. This means that an operator repeats the soldering for as many couplings as there are between the metallic tubular members. For example, a double horn has sixteen couplings, and an operator repeats the solderings for the sixteen rounded end portions. This is time consuming, and the soldering stage increases the production costs of the wind instrument.

FIGS. 4 and 5 illustrate another prior art metallic tubular member 3 including a straight tube 3*a* and a mouth ring 3*b*.

As will be better seen from FIG. 6, the inner surface of the straight tube 3*a* is chamfered, and the mouth ring 3*b* is loosely inserted into the end portion of the straight tube 3*a*. The mouth ring 3*b* is soldered to the end portion of the straight tube 3*a*, and the solder film 3*c* affixes the mouth ring 3*b* to the end portion.

After the soldering, the metallic tubular member 3 is coated through a plating bath. However, any residual electrolyte is confined in the metallic tubular member 3, because the mouth ring 3*b* and the end portion of the straight tube 3*a* do not form any space.

When another metallic tubular member 4 is coupled with the metallic tubular member 3, the chamfer guides the straight end of the metallic tubular member 4, and the metallic tubular member 4 is easily inserted into the end portion of the metallic tubular member 3.

Thus, the second prior art metallic tubular members 3 and 4 are easily assembled into a wind instrument, and is free from the residual electrolyte. However, the second prior art metallic tubular member 3 needs two additional stages. Namely, the straight tube 3*a* is chamfered by grinding the inner surface of the end portion, and the mouth ring 3*b* is soldered to the outer surface of the end portion. These additional steps are also time consuming, and increase preduction costs.

SUMMARY OF THE INVENTION

It is therefore an important object of the present invention to provide a wind instrument which improves manufacturing productivity without sacrifice of mechanical strength or easy assembly.

It is also an important object of the present invention to provide a process for forming a tubular member incorporated in the wind instrument which enhances the productivity of manufacture of the wind instrument without sacrifice of mechanical strength or easy assembly.

To accomplish these and other related objects, the present invention forms a tubular member having a coupling portion in such a manner as to form a hollow space open to an inner space of the tubular member.

In accordance with one aspect of the present invention, there is provided a wind instrument having a wind passage for producing a sound comprising: a) a first tubular member having a tubular portion for defining a first inner space and a coupling portion larger in inner diameter than the tubular portion and winding the end of the tubular portion radially inward for forming a hollow space open to the first inner space; and b) a second tubular member having an end portion inserted through the coupling portion into the tubular portion for conducting a second inner space thereof to the first inner space, the first and second inner spaces forming parts of the wind passage.

In accordance with another aspect of the present invention, there is provided a process of forming a tubular member incorporated in a wind instrument, comprising the steps of: a) preparing a tubular member having an intermediate portion defining an inner space and an end portion merged into the intermediate portion; b) increasing the inner diameter of the end portion; and c) winding the end portion radially inward for forming a hollow space open to the inner space.

BRIEF DESCRIPTION OF THE DRAWINGS

The features and advantages of the wind instrument according to the present invention will be more clearly understood from the following description taken in conjunction with the accompanying drawings in which.

DESCRIPTION OF THE PREFERRED EMBODIMENTS

Figure 1:
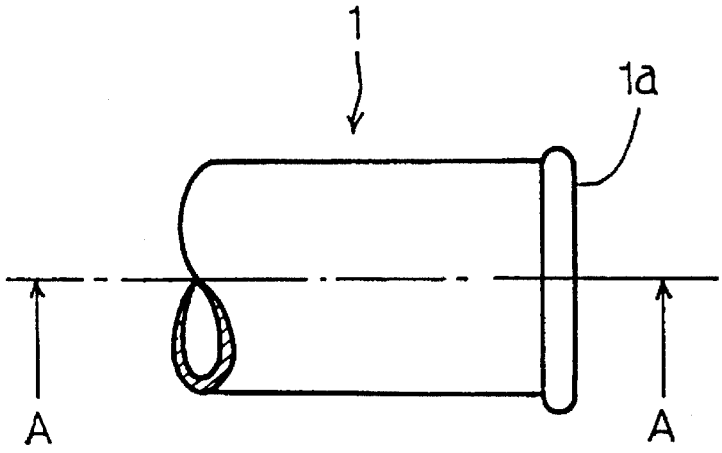
Fig.1 PRIOR ART
FIG. 1 is a front view showing a prior art metallic tubular part of a prior art wind instrument.
Figure 2:
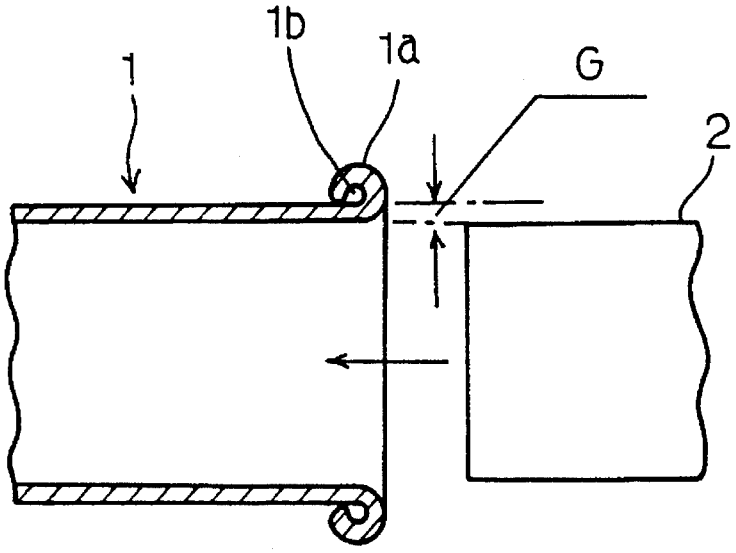
Fig.2 PRIOR ART
FIG. 2 is a cross sectional view taken along line A—A of FIG. 1.
Figure 3:
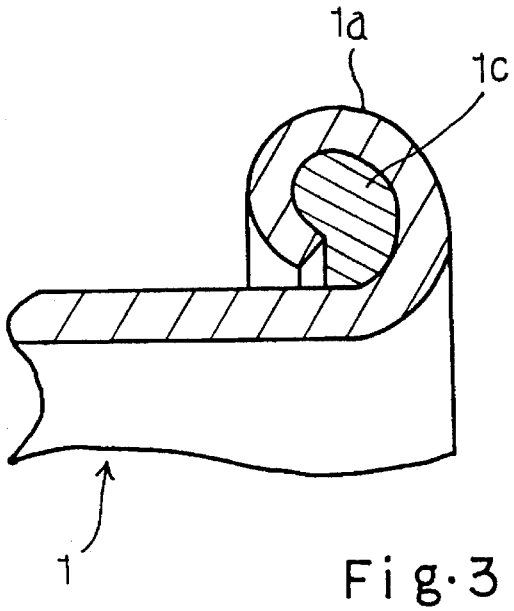
Fig·3 PRIOR ART
FIG. 3 is a fragmentary perspective view of a prior art metallic tubular member.
Figure 4:
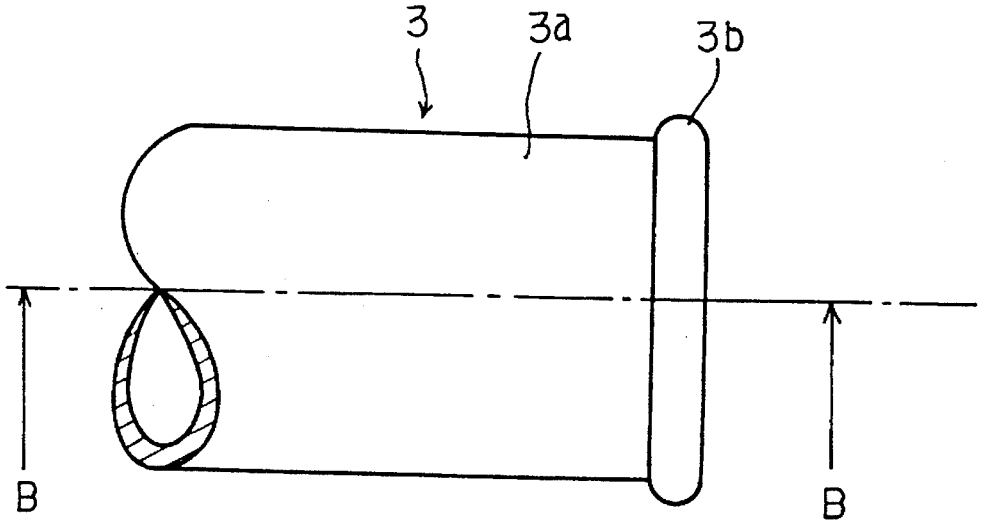
Fig·4 PRIOR ART
FIG. 4 is a front view showing a second prior art metallic tubular member.
Figure 5:
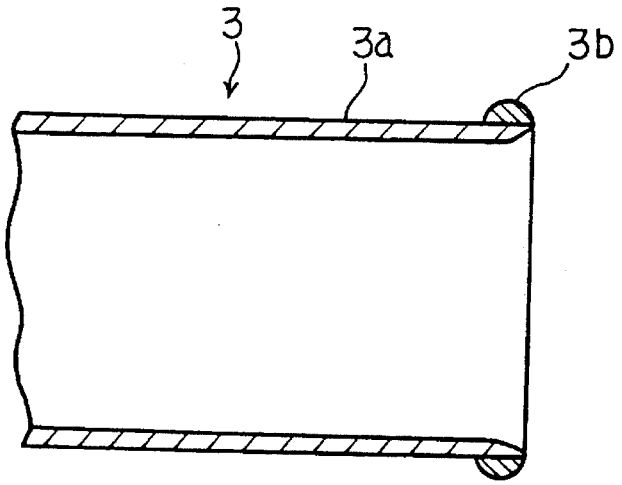
Fig. 5 PRIOR ART
FIG. 5 is a cross sectional view taken along line B—B of FIG. 4.
Figure 6:
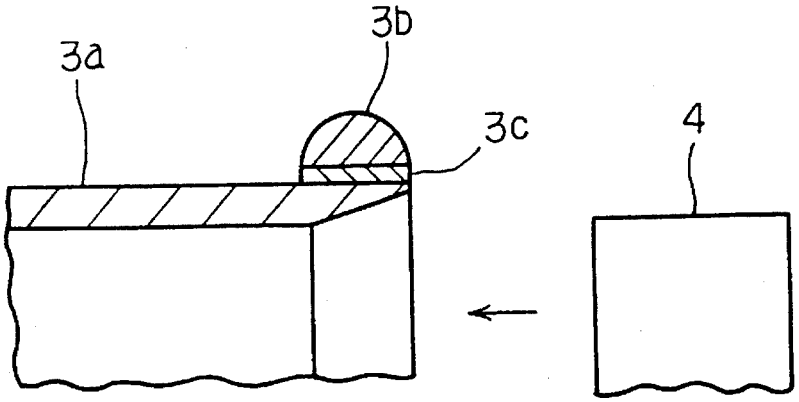
Fig. 6 PRIOR ART
FIG. 6 is a cross sectional view showing, in an enlarged scale, the end portion of the second prior art metallic tubular member.
Figure 7:
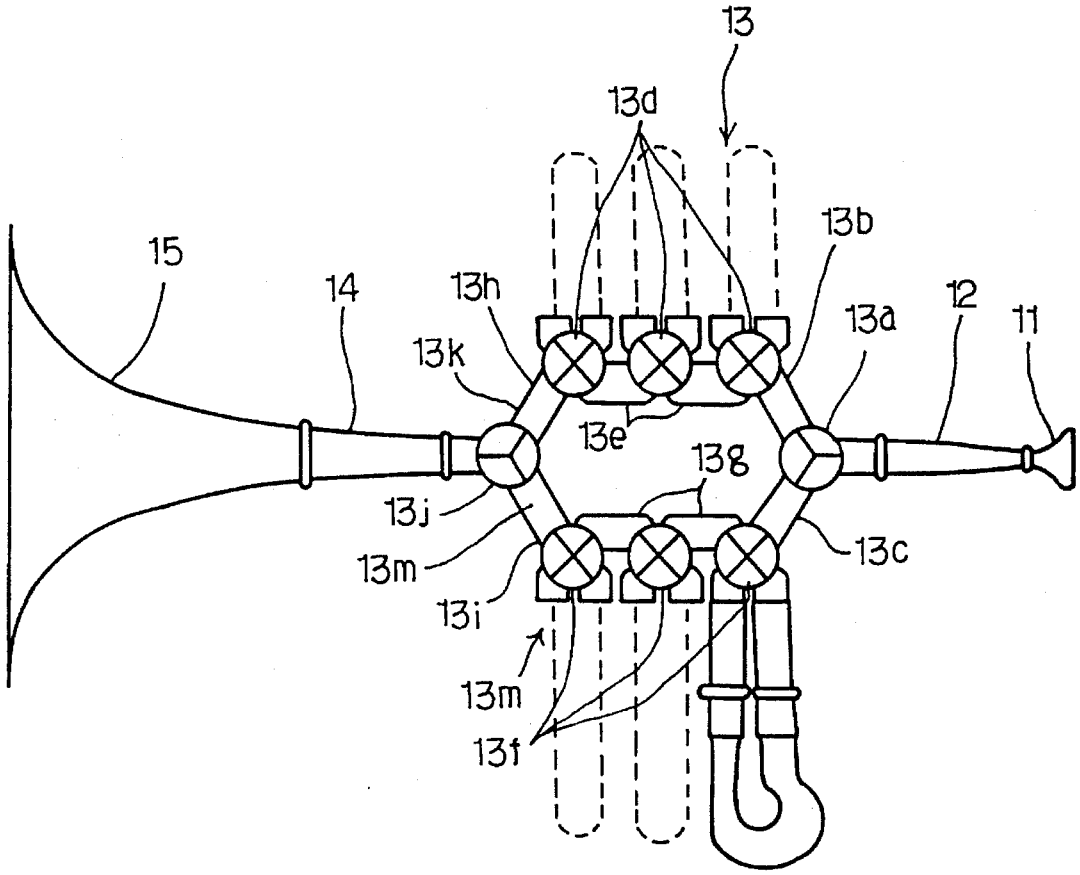
FIG. 7 is a front view showing the structure of an ideal double French horn according to the present invention.

Referring to FIG. 7 of the drawings, an ideal double French horn is embodied in accordance with the present invention, and largely comprises a mouth piece 11, a front tubular member 12, an intermediate tube network 13, a rear tubular member 14 and a bell 15. The mouth piece 11, the front tubular member 12, the intermediate tube network 13, the rear tubular member 14 and the bell 15 are formed of a coated alloy or are plated with a noble metal. Although all the component tubes are straight, curved and/or coiled tubes may be incorporated in a practical double French horn.

The mouth piece 11 is inserted into a front end of the front tubular member 12, which in turn is coupled with the intermediate tube network 13.

The intermediate tube network 13 is fabricated from a front change-over valve 13*a*, two front straight tubular members 13*b* and 13*c*, a set of valve units 13*d* coupled through interconnecting tubular members 13*e*, another set of valve units 13*f* also coupled through interconnecting tubular members 13*g* connected with the rear end of the front tubular member 12, two rear straight tubular members 13*h* and 13*i* and a rear change-over valve 13*j*. The front change-over valve 13*a* has an inlet coupled with the rear end of the front tubular member 12, and the front straight tubular members 13*b* and 13*c* are coupled with two outlets of the front change-over valve 13*a*. The set of valve units 13*d* is coupled between the front straight tubular member 13*b* and the rear straight tubular member 13*h*, and the other set of valve units 13*f* is coupled between the front straight tubular member 13*c* and the rear straight tubular member 13*i*. The rear straight tubular members 13*h* and 13*i* are respectively coupled with two inlets of the rear change-over valve 13*j*. The outlet of the rear change-over valve 13*j* is coupled with the rear tubular member 14.

The front straight tubular member 13*b*, the set of valve units 13*d*, the interconnecting tubular members 13*e* and the rear straight tubular member 13*h* form a wind sub-passage 13*k* therein. The front straight tubular member 13*c*, the set of valve units 13*f*, the interconnecting tubular members 13*g* and the rear straight tubular member 13*i* form another wind sub-passage 13*m* therein. The wind sub-passage 13*k* is assigned to the key note F, and the other wind sub-passage 13*m* is assigned to the key note $B^b$. A player manipulates the front and rear change-over valves 13*a* and I 3*j* so that one of the wind sub-passages 13*k* and 13*m* is conducted between the front tubular member 12 and the rear tubular member 14. Though not shown in FIG. 7, the valve units 13*d* or 13*f* add air passages to the wind sub-passage 13*k* or 13*m*, and a player changes the pitch of a sound by manipulating on the valve units 13*d* or 13*f*.

The rear end of the rear tubular member 14 is inserted into the front end of the bell 15, and a column of air is created from the front tubular member 12 through either wind sub-passage 13*k* or 13*m*, and from the rear tubular member 14 to the bell 15. When the player buzzes on the mouth piece 11, the column of air vibrates, and produces the sound.

Figure 8:
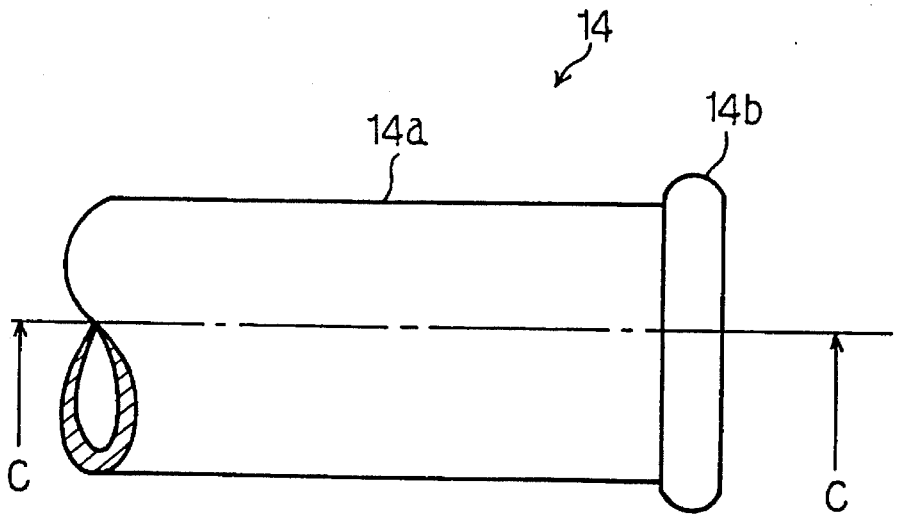
FIG. 8 is a front view showing a front end portion of a rear tubular member incorporated in the ideal double French born.
Figure 9:
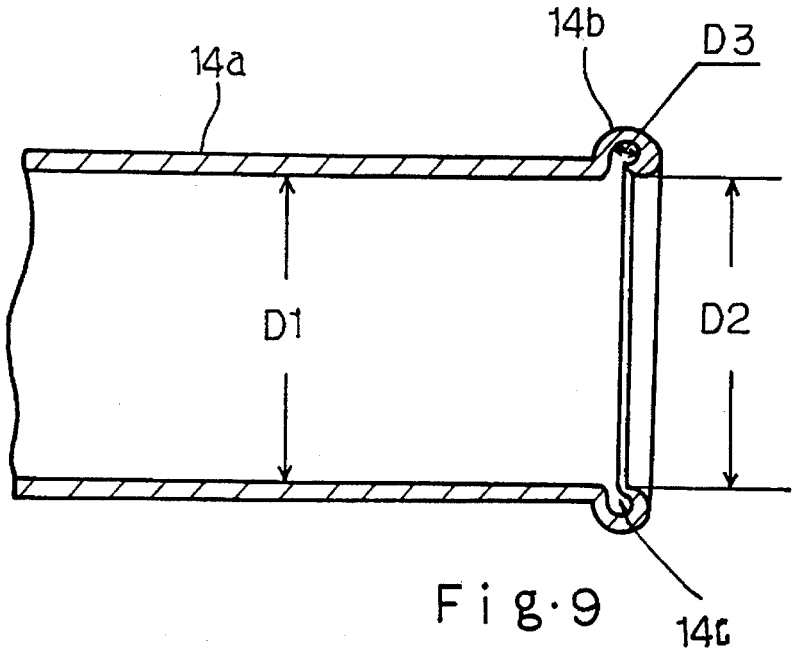
FIG. 9 is a cross sectional view taken line C—C of FIG. 8.

Turning to FIGS. 8 and 9 of the drawings, the front end portion of the rear tubular member 14 is illustrated in an enlarged scale. Although the present invention relates to all of the connections between two component tubular members, reference is made to the front end portion of the rear tubular member 14 to avoid repetition.

The front end portion of the rear tubular member 14 comprises a straight tubular sub-portion 14*a* having a substantially constant diameter. A guide sub-portion 14*b* merges into the straight tubular sub-portion 14*a*. The straight tubular sub-portion 14*a* has a smaller inner diameter than the diameter of the guide sub-portion 14*b*. The guide sub-portion 14*b* smoothly guides the outlet of the rear change-over valve 13*j* into the straight tubular sub-portion 14*b*. The outer diameter of the outlet of the rear change-over valve 13*j* is not greater than the inner diameter of the straight sub-portion 14*a*. In this instance, the straight tubular sub-portion 14*a* and the guide sub-portion 14*b* serve as a tubular portion and a coupling portion, respectively.

Figure 10:
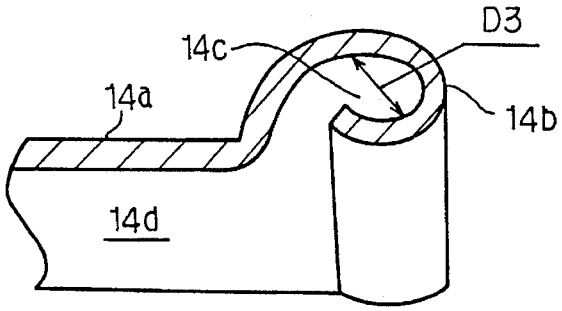
FIG. 10 is a fragmentary perspective view showing, in an enlarged scale 1, the front end portion of a rear tubular member.

As will be better seen from FIG. 10, the guide sub-portion 14*b* winds from the straight tubular sub-portion 14*a* in the clockwise direction, i.e., winds radially inward, and projects from the outer surface of the straight sub-portion 14*b*. The winding guide sub-portion 14*b* forms a hollow space 14*c*, and the hollow space 14*c* is exposed to the inner space 14*d* in the straight tubular sub-portion 14*a*. The maximum inner diameter D3 of the rounded guide sub-portion 14*b* is less than the inner diameter D1 of the straight tubular sub-portion 14*a*. The relationship between the inner diameters D1, D2 and D3 are expressed as follows.

$$D2>D1>D3$$

The relationship between the inner diameters D1 and D2 is desirable for smooth insertion, because the guide sub-portion 14*b* takes up the misalignment between the center of the straight tubular sub-portion 14*a* and the center of the outlet of the rear change-over valve 13*j*.

Moreover, the shape of the guide sub-portion 14*b* is larger in the modulus section than the straight tubular sub-portion 14*a*, and, accordingly, reinforces the rear tubular member 14.

Even if the manufacturer coats the rear tubular member 14 through a plating bath, residual electrolyte does not deteriorate the external appearance of the double French horn, because the inner space 14*c* is open at the inner space 14*d* of the straight tubular sub-portion 14*a*. The residual electrolyte may tarnish the inner surface of the rear tubular member 14. However, the tarnished inner surface does not shorten the service life of the double French horn, nor deteriorate the attractive appearance. For this reason, it is not necessary to close the space 14*c* by means of pieces of solder. This results in the reduction of production costs.

Described below is a process for forming a tubular member incorporated in a wind instrument according to the present invention. The process starts with preparing of a tubular member 24. The tubular member 24 has an intermediate portion 24*a* corresponding to the straight tubular sub-portion 14*a* and an end portion merged into the intermediate portion 24*a*.

Figure 11A:
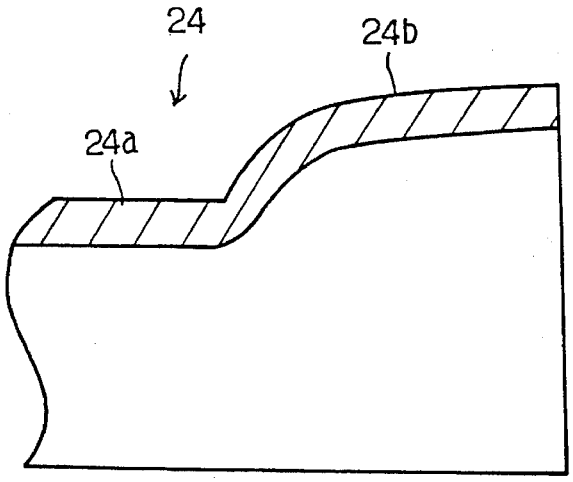
FIGS. 11A and 11B are fragmentary perspective views showing a forming process of the front end portion of the rear tubular member.

The end portion 24*b* then expanded, and is increased in inner diameter as shown in FIG. 11A. A press working may be applied to the end portion by using male and female dies.

Figure 11B:
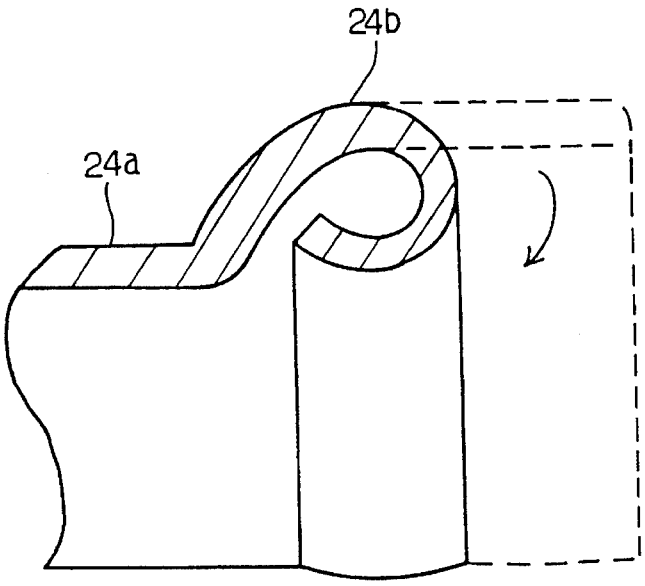

The expanded end portion 24*b* is rounded as shown in FIG. 11B, and the rounded end portion 24*b* serves as the guide sub-portion 14*b*. Therefore, the minimum inner diameter of the rounded end portion 24*b* is larger than the inner diameter of the intermediate portion 24*a*, and a hollow space is open to the inner space of the intermediate portion 24*a*. The end portion may be also shaped through a press working.

The tubular member 24 thus shaped is coated or plated through a plating bath, and forms a part of a wind instrument similar to the rear tubular member 14.

As will be appreciated from the foregoing description, the tubular member according to the present invention is prevented from residual electrolyte confined during a plating bath without sacrifice of mechanical strength or easy assembly.

When the present invention is used in connection with a double tube member of, for example, a double horn, a trumpet or a trombone, the outer tube of the double tube member has an end portion similarly arranged to the coupling sub-portion 14*b* and merges into a straight tubular portion. Namely, the end portion of the outer tube has a boss portion projecting radially outward from the outer surface of the outer tube and a leading portion merged into the boss portion which is found radially inward rounding from the boss portion. The straight tubular portion is smaller in inner diameter than the wound end portion, and a hollow space defined by the end portion is open to the inner space of the straight tubular portion. A length of the hollow space is less than the inner diameter of the straight tubular portion. However, the inner diameter of the straight tubular portion may be equal to the minimum inner diameter of the end portion.

An inner tube is smoothly inserted into the outer tube similar to the rear tubular member 14 and the rear change-over valve 13*j*. The outer tube achieves all the advantages of the rear tubular member 14.

Although particular embodiments of the present invention have been shown and described, it will be obvious to those skilled in the art that various changes and modifications may be made without departing from the spirit and scope of the present invention. The present invention is applicable to any brass instrument such as a trumpet, a trombone, a tuba or a flute as well as to a woodwinds formed of metal and/or alloy.

What is claimed is:

1. A wind instrument having a wind passage for producing a sound comprising:

a first tubular member having a tubular portion and an integrally formed coupling portion having a leading end for guiding a second tubular member into said first tubular member, said tubular portion defining a first inner space having a first inner diameter, said coupling portion having a second inner diameter, said second inner diameter at said leading end being greater than said first inner diameter, and a major portion of said leading end winding radially inward towards said first inner space for forming a second inner space in communication with said first inner space.

2. The wind instrument having a wind passage as set forth in claim 1, including a second tubular member coupled to said tubular portion through said coupling portion, said second tubular member defining a third inner space in communication with said first inner space.

3. The wind instrument as set forth in claim 2, in which said second tubular member includes an outer diameter, and said second inner diameter of said coupling portion is greater than said outer diameter.

4. The wind instrument as set forth in claim 1, in which said tubular portion has an outer surface and said coupling portion has a boss sub-portion merged with said leading end, said sub-portion projecting radially outward from said outer surface of said tubular portion.

5. The wind instrument as set forth in claim 1, in which said second inner space has a maximum length and the maximum length of said second inner space is less than said first inner diameter of said tubular portion.

6. The wind instrument as set forth in claim 1, in which said first tubular member is plated with a metal coating.

7. The wind instrument as set forth in claim 1, in which the leading end extends along the circumference of the coupling portion, and winds radially inward towards the first inner space along the circumference of the coupling portion.

8. A wind instrument having a wind passage for producing a sound comprising:

a first tubular member plated with a coating film and having a tubular portion including an outer surface, said tubular portion defining a first inner space having a first inner diameter, and said tubular portion including an integrally formed coupling portion having a second inner diameter for guiding a second tubular member into said first tubular member, said coupling portion including a leading end sub-portion and an integral boss sub-portion, said second inner diameter at said leading end sub-portion being greater than said first inner diameter, said boss sub-portion projecting radially outward from said outer surface of said tubular portion, and said leading end sub-portion winding radially inward from said boss sub-portion substantially about the circumference of said leading end sub-portion for forming a second inner space in communication with said first inner space, said second inner space having a maximum length and said maximum length being less than said first inner diameter; and a second tubular member having an end portion coupled to said tubular portion through said coupling portion, said second tubular member defining a third inner space in communication with said first inner space, said end portion including an outer diameter which is less than the second inner diameter.

9. A process for forming a tubular member incorporated in a wind instrument, comprising the steps of:

a) providing a tubular member having an outer surface, said tubular member including a tubular portion and an integrally formed coupling portion for guiding a second tubular member into said first tubular member, said coupling portion having a leading end and an integrally formed boss portion, said tubular portion defining a first inner space and said coupling portion having an inner diameter;

b) increasing the inner diameter of said coupling portion;

c) projecting said boss portion radially outward from said outer surface of said tubular member; and d) winding said leading end radially inward from said boss portion substantially about the circumference of said leading end for forming a second inner space in communication with said first inner space.

10. The process as set forth in claim 9, in which said tubular member is plated by dipping into an electrolyte after said step of winding inward said leading end.

11. A wind instrument having a wind passage for producing a sound comprising:

a first tubular member having a tubular portion and an integrally formed coupling portion having a leading end for guiding a second tubular member into said first tubular member, said tubular portion including an outer surface and defining a first inner space having a first inner diameter, said coupling portion having a second inner diameter and a boss sub-portion merged with said leading end, said boss sub-portion projecting radially outward from said outer surface of said tubular portion, and said second inner diameter at said leading end being greater than said first inner diameter, and said leading end winding radially inward towards said first inner space substantially along the circumference of said leading end for forming a second inner space in communication with said first inner space.

12. A wind instrument having a wind passage for producing a sound comprising:

a first tubular member having a tubular portion and an integrally formed coupling portion having a leading end for guiding a second tubular member into said first tubular member, said leading end extending continuously along the circumference of the coupling portion, said tubular portion defining a first inner space having a first inner diameter, said coupling portion having a second inner diameter, said second inner diameter at said leading end being greater than said first inner diameter, and said leading end winding radially inward towards said first inner space continuously along at least half of the circumference of the coupling portion for forming a second inner space in communication with said first inner space.

* * * * *